US008382218B2

(12) United States Patent
Placke et al.

(10) Patent No.: US 8,382,218 B2
(45) Date of Patent: Feb. 26, 2013

(54) REFRIGERATOR COMPRISING A TELESCOPIC PULL-OUT MECHANISM

(75) Inventors: Frank Placke, Bielefeld (DE); Matthias Stahl, Schloβ Holte-Stukenbrock (DE); Helmut Steichele, Lauingen (DE); Ulrich van Pels, Rheda-Wiedenbrück (DE)

(73) Assignees: BSH Bosch und Siemens Hausgeraete GmbH, Munich (DE); Miele & Cie. KG, Gütersloh (DE)

( * ) Notice: Subject to any disclaimer, the term of this patent is extended or adjusted under 35 U.S.C. 154(b) by 303 days.

(21) Appl. No.: 12/525,562

(22) PCT Filed: Jan. 21, 2008

(86) PCT No.: PCT/EP2008/050650

§ 371 (c)(1),
(2), (4) Date: Aug. 3, 2009

(87) PCT Pub. No.: WO2008/095765

PCT Pub. Date: Aug. 14, 2008

(65) Prior Publication Data

US 2010/0001624 A1 Jan. 7, 2010

(30) Foreign Application Priority Data

Feb. 6, 2007 (DE) ..... 10 2007 005 948

(51) Int. Cl.
*A47B 96/04* (2006.01)
*A47B 88/00* (2006.01)

(52) U.S. Cl. ..... 312/404; 312/334.7

(58) Field of Classification Search ..... 312/311, 312/334.7, 334.8, 334.1, 404, 402, 350, 334.9, 312/334.11, 334.12, 408; 384/18, 19; 108/108
See application file for complete search history.

(56) References Cited

U.S. PATENT DOCUMENTS

| | | | | | |
|---|---|---|---|---|---|
| 2,692,802 | A | * | 10/1954 | Bienias et al. | 384/19 |
| 2,799,541 | A | * | 7/1957 | Wolters | 384/19 |
| 3,078,130 | A | * | 2/1963 | Beeck | 384/19 |
| 3,164,419 | A | * | 1/1965 | Michaelson | 384/18 |
| 4,196,943 | A | * | 4/1980 | Rock et al. | 384/19 |
| 4,458,964 | A | * | 7/1984 | Hardy | 312/334.12 |
| 5,040,856 | A | * | 8/1991 | Wilkins et al. | 312/402 |
| 5,340,209 | A | * | 8/1994 | Kolbe et al. | 312/408 |
| 5,484,199 | A | * | 1/1996 | Gasser et al. | 312/334.33 |
| 5,564,807 | A | * | 10/1996 | Rock et al. | 312/331 |
| 5,787,911 | A | * | 8/1998 | Jacobus et al. | 134/201 |
| 5,813,741 | A | * | 9/1998 | Fish et al. | 312/408 |
| 6,076,908 | A | * | 6/2000 | Maffeo | 312/334.7 |
| 6,478,393 | B2 | * | 11/2002 | Kim et al. | 312/334.12 |

(Continued)

FOREIGN PATENT DOCUMENTS

| | | | |
|---|---|---|---|
| JP | 2000249125 | A * | 9/2000 |
| WO | 2007007950 | A1 | 1/2007 |

*Primary Examiner* — Janet M Wilkens
*Assistant Examiner* — Andrew Roersma
(74) *Attorney, Agent, or Firm* — James E. Howard; Andre Pallapies

(57) ABSTRACT

A refrigerator is provided that includes a carcass, a door, and a support for goods to be cooled. The support is mounted within the carcass via telescopic pull-out mechanisms for extending movement outwardly of the carcass and retracting movement inwardly relative to the carcass. A shell covers each telescopic pull-out mechanism on a top side, a longitudinal side facing the support, and a front side facing the door thereof.

28 Claims, 2 Drawing Sheets

U.S. PATENT DOCUMENTS

| | | | | |
|---|---|---|---|---|
| 7,156,478 | B2 * | 1/2007 | Harn et al. | 312/334.6 |
| 7,228,612 | B2 * | 6/2007 | Lyvers | 29/527.1 |
| 2004/0174108 | A1 * | 9/2004 | Benitsch et al. | 312/408 |
| 2005/0160854 | A1 | 7/2005 | Rotter | |
| 2005/0210655 | A1 * | 9/2005 | Lyvers | 29/527.1 |
| 2005/0225220 | A1 * | 10/2005 | Huang | 312/348.4 |
| 2006/0266070 | A1 * | 11/2006 | Ertz et al. | 62/441 |

* cited by examiner

REFRIGERATOR COMPRISING A TELESCOPIC PULL-OUT MECHANISM

BACKGROUND OF THE INVENTION

The present invention relates to a refrigeration appliance with a carcass, a door and a support for chilled goods that is supported in the carcass in such a manner that it can be pulled out by way of telescopic pull-out mechanisms. The telescopic rails that are visible when the door is open are felt to be aesthetically displeasing; in the pulled out state it is possible for a user to injure themselves or dirty their clothing through contact with the frequently sharp-edged sheet-metal parts of the telescopic rails. In the case of a freezer, gaps left open between side walls of the carcass and pull-out drawers supported therein on telescopic pull-out mechanisms form inlet channels, through which unwanted heat enters the appliance when the door is open.

BRIEF SUMMARY OF THE INVENTION

The object of the present invention is to eliminate the cited disadvantages.

This object is achieved in that in the case of a refrigeration appliance with a carcass, a door and a support for chilled goods that is supported in the carcass in such a manner that it can be pulled out by way of telescopic pull-out mechanisms a shell covers each telescopic pull-out mechanism at least on an upper face, a longitudinal face facing the support and a front face facing the door.

The shell is preferably made up of a cut flat material forming the upper face and the longitudinal face and a molded part forming the front face. Although the cut flat material can be a metal sheet, the molded part is preferably an injection molded plastic part.

If the cut flat material also forms a lower face of the shell, the molded part is preferably latched to the upper and lower faces.

To this end the molded part can have tabs engaging round the upper and lower faces, which are provided with a latching projection engaging in an opening on the upper and/or lower face.

According to an alternative embodiment the cut flat material can be molded to form a hollow chamber, in which a pin on the molded part engages for anchorage purposes.

If the support for chilled goods is a pull-out drawer, the front face of the shell is preferably the same height as the pull-out drawer in order, together with the latter, to form the most closed front surface possible to impede the ingress of warm air into the interior of the refrigeration appliance.

BRIEF DESCRIPTION OF THE DRAWINGS

Further features and advantages of the invention will emerge from the description which follows of exemplary embodiments with reference to the accompanying figures, in which.

DETAILED DESCRIPTION OF EXEMPLARY EMBODIMENTS OF THE PRESENT INVENTION

Figure 1:
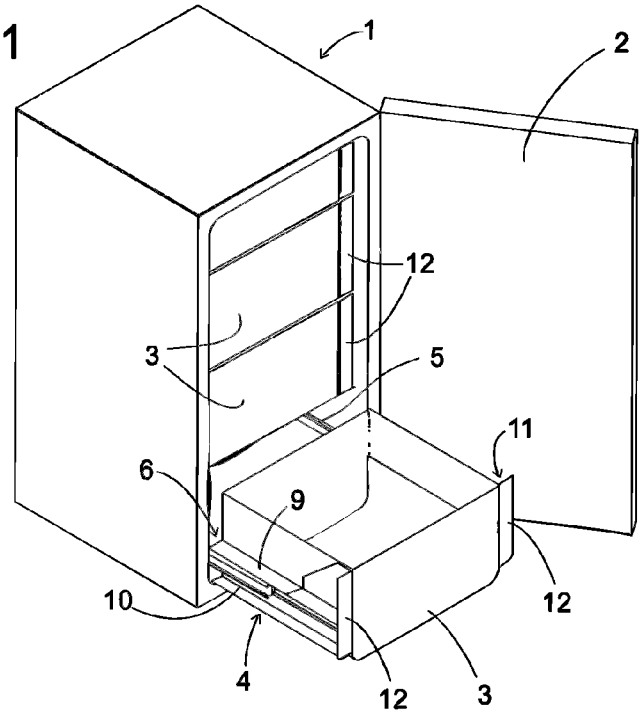
FIG. 1 shows a perspective view of an inventive refrigeration appliance.

FIG. 1 shows a perspective view of a freezer with a carcass 1, a door 2 and a number of pull-out drawers 3 guided on telescopic pull-out mechanisms 4, 5, the lowest of said pull-out drawers 3 being shown in the pulled-out position. The telescopic pull-out mechanisms 4, 5 are held respectively in a longitudinally extended shell 6, which, as shown in FIG. 3, comprises a sheet metal profile 7 extending in the longitudinal direction of the telescopic pull-out mechanism with a longitudinal face 8 facing the pull-out drawer 3, an upper face 9 and a lower face 10 as well as a molded body 11 made of plastic, which forms a closed front face 12 of the shell 6. Alternatively the shell 6 could also be formed from a plastic molded part. The shell 6 is fixed in a detachable manner to the telescopic pull-out mechanisms 4, 3 using securing means (not shown in more detail). A segment 13 with a three-sided cross-section adjoins the front face 12 of the molded body 11, enclosing the sheet metal profile 7 closely at its door end, as shown in particular in the section in FIG. 2. The segment 13 comprises two horizontal tabs 14, 15, which rest respectively on the outside of the upper face 9 and/or the lower face 10 of the sheet metal profile 7 and have a latching projection 17 engaging in an opening 16 or depression in the sheet metal profile 7. The engagement of the latching projections 17 in the openings 16 and the form fit between the segment 13 and sheet metal profile 7 anchor the molded body 11 securely to the sheet metal profile 7.

The front face 12 of the molded body extends upward over the upper face 9 of the sheet metal profile 7. The projecting segment of the front face 12 is stiffened by a wall 18, which connects it to the upper tab 14. The height of the front face 12 corresponds essentially to the height of the adjacent pull-out drawer 3, so that, as shown in FIG. 1, the front faces 12 of shells located one above the other follow on from one another, only separated by narrow gaps, and combine to form a largely closed surface.

Figure 2:
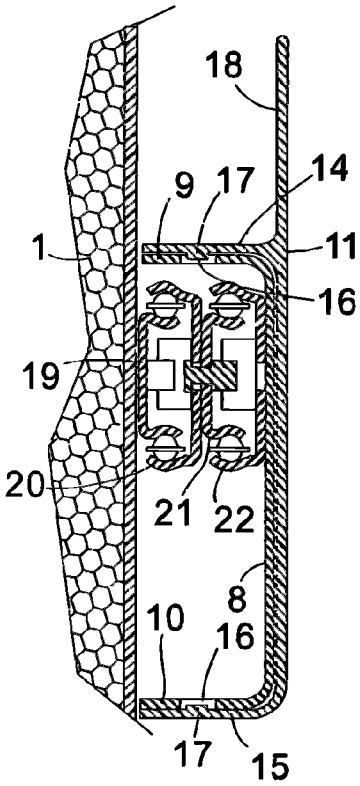
FIG. 2 shows a section through a telescopic pull-out mechanism of the refrigeration appliance.
Figure 3:
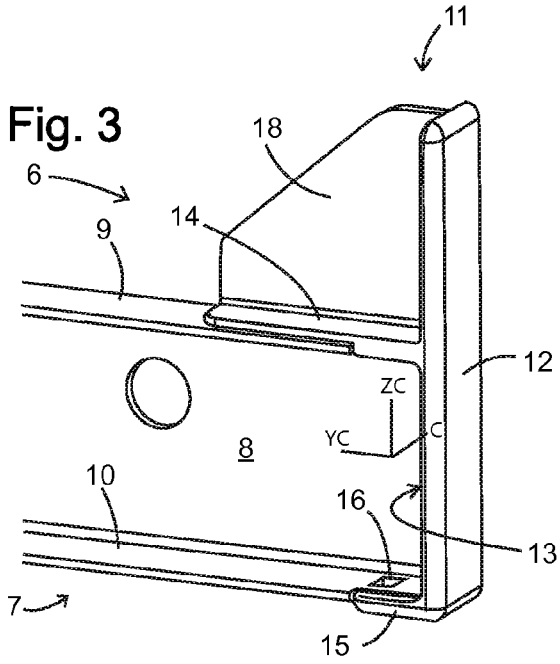
FIG. 3 shows a perspective partial view of a shell covering the telescopic pull-out mechanism according to a first embodiment of the invention.

The telescopic pull-out mechanism 4 held in the shell 6 is, as shown in FIG. 2, a total pull-out mechanism with one fixed rail 19 anchored to the wall of the carcass 1, one rail 22 that can be moved with the pull-out drawer 3 and intermediate rails 20, 21 between them, which are connected permanently to one another. The upper face 9 of the shell 8 covers the rails 19-22 completely, so that the risk of unintended contact with the rails and the associated risk of injury or dirtying is largely eliminated.

Figure 4:
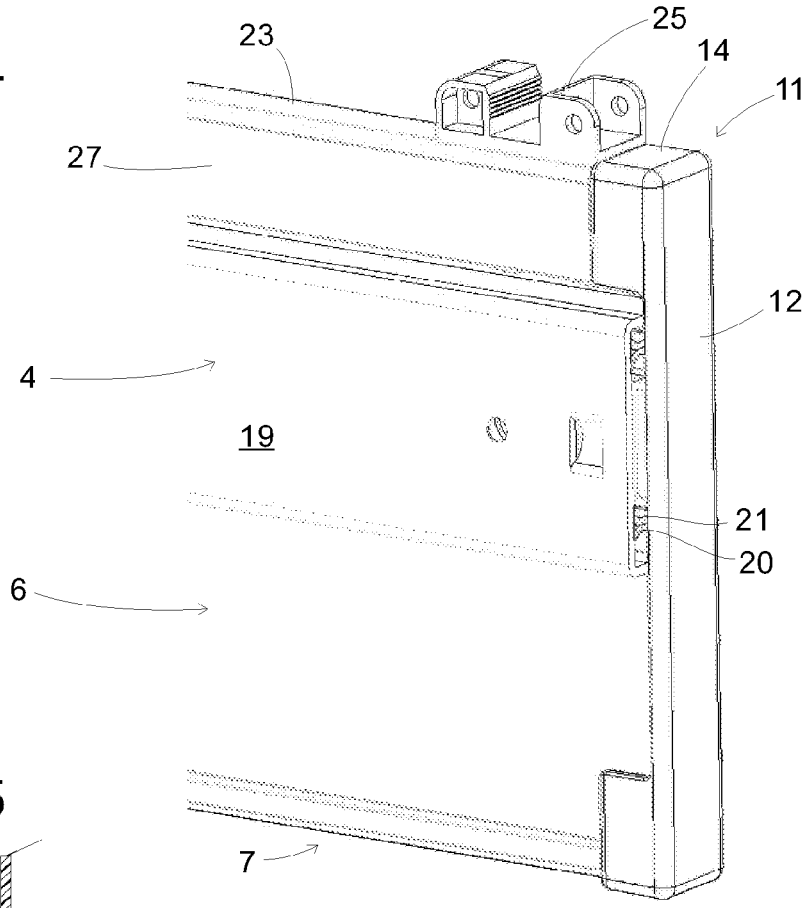
FIG. 4 shows a perspective view of a shell according to a second embodiment of the invention.
Figure 5:
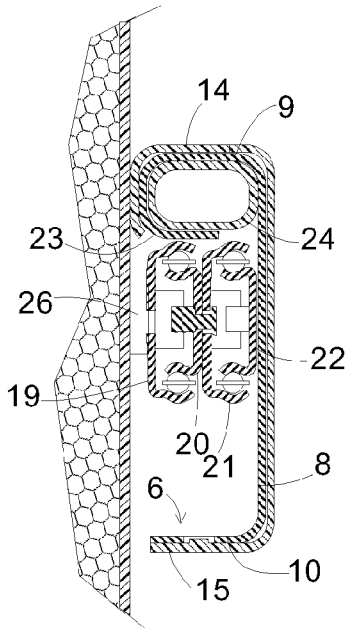
FIG. 5 shows a section through the shell in FIG. 4 and a telescopic pull-out mechanism covered by it.

FIG. 4 shows a perspective view of a telescopic pull-out mechanism 4 and a shell 6 covering it according to a second embodiment of the invention. Here too the shell 6 is formed by a sheet metal profile 7 and a molded body 11 positioned on the door end of the sheet metal profile 7 but with an upper peripheral region of the sheet metal profile 7 here being rolled into a square tube 23, as can be seen in the cross-section in FIG. 5. A hollow pin 24 on the molded body 11 is inserted into a door end of this square tube 23, to anchor the molded body 11 to the sheet metal profile 7. Secured to the sheet metal profile 7 is an adapter 25, onto which the pull-out drawer can be latched.

Projections 26 projecting in the direction of the wall of the carcass 1 are embossed on the fixed rail 19 of the telescopic pull-out mechanism 4, to secure the rail 19 to the wall of the carcass 1. The main part of the rail 19 therefore moves back to some degree behind the outer surface 27 of the square tube 23 facing the wall. The fixed rail 19 engages round the intermediate rail 20 at the top and bottom; in other words the intermediate rail 20 is the narrower of the two rails. It is therefore inconspicuous even when the pull-out drawer 3 is in the pulled out position and retreats visually behind the more visible outer surface 27 of the shell, so that the entire telescopic pull-out mechanism is now barely noticeable to the user.

The invention claimed is:

1. A refrigeration appliance comprising:

a carcass;

a door;

a pair of telescopic mechanisms;

a support for chilled goods, the support being secured to the carcass via the pair of telescopic mechanisms and the pair of telescopic mechanisms being operable to permit the support to move outwardly relative to the carcass and to retract inwardly relative to the carcass; and a pair of cover elements, each cover element having an upper face, longitudinal face and substantially vertical front face substantially covering, respectively, at least an upper face, a longitudinal face facing the support, and a substantially vertical front face of a respective telescopic mechanism, each cover element including a first part and a second part that are latched to one another, wherein the front face of each cover element is generally flush with a substantially vertical front face of the support that is outwardly exposed, such that the front faces of the cover elements and the front face of the support together generally face an inside surface of the door when the door is closed.

2. The refrigeration appliance as claimed in claim 1, wherein each cover element is configured at least approximately as a shell having the first and second parts.

3. The refrigeration appliance as claimed in claim 2, wherein the first part of the shell comprises a cut material that forms the upper face and the longitudinal face and the second part of the shell comprises a molded part forming the front face.

4. The refrigeration appliance as claimed in claim 3, wherein the cut material includes a lower face of the shell and the molded part is latched to the upper and lower faces.

5. The refrigeration appliance as claimed in claim 4, wherein the molded part has tabs engaging the upper and lower faces and each tab includes a latching projection engaging in an opening on one of the upper and lower faces.

6. The refrigeration appliance as claimed in claim 3, wherein the cut material is configured as a tube.

7. The refrigeration appliance as claimed in claim 6, wherein a pin on the molded part engages in the tube.

8. The refrigeration appliance as claimed in claim 1, wherein the cover element is configured as a molded part.

9. The refrigeration appliance as claimed in claim 1, wherein each cover element is secured to the telescopic mechanisms in a detachable manner.

10. The refrigeration appliance as claimed in claim 1, wherein the front face of the support is positioned between the front faces of the cover elements, with one said front face of one of the cover elements being positioned on one lateral side of the front face of the support and another said front face of another of the cover elements being positioned on another lateral side of the front face of the support.

11. The refrigeration appliance as claimed in claim 1, wherein the front face of the support is generally co-planar with the front faces of the cover elements.

12. The refrigeration appliance as claimed in claim 1, wherein each cover element includes a lower base that covers a lower face of a respective telescopic mechanism.

13. The refrigeration appliance as claimed in claim 1, further comprising another support including associated cover elements, wherein the associated cover elements of said another support are closely spaced from the cover elements of the support to form a substantially closed and continuous surface.

14. The refrigeration appliance as claimed in claim 1, wherein the first part comprises metal and the second part comprises a molded material.

15. A refrigeration appliance comprising:

a carcass;

a door;

a pair of telescopic mechanisms;

a support for chilled goods, the support being secured to the carcass via the pair of telescopic mechanisms and the pair of telescopic mechanisms being operable to permit the support to move outwardly relative to the carcass and to retract inwardly relative to the carcass; and a pair of cover elements, each cover element having an upper face, longitudinal face and front face substantially covering, respectively, at least an upper face, a longitudinal face facing the support, and a front face of a respective telescopic mechanism, wherein the support is a pull-out drawer and the height of the front face of each cover element is equal to the height of the pull-out drawer.

16. A refrigeration appliance comprising:

a carcass;

a door;

a pair of telescopic mechanisms;

a support for chilled goods, the support being secured to the carcass via the pair of telescopic mechanisms and the pair of telescopic mechanisms being operable to permit the support to move outwardly relative to the carcass and to retract inwardly relative to the carcass;

a pair of cover elements, each cover element having an upper face, longitudinal face and front face substantially covering, respectively, at least an upper face, a longitudinal face facing the support, and a front face of a respective telescopic mechanism; and a stiffening wall, extending parallel to the longitudinal face of the cover element and extending above the upper face of the cover element, wherein the front wall of the cover element includes a projected segment that extends above the upper face of the cover element and is stiffened by the stiffening wall.

17. A refrigeration appliance comprising:

a carcass;

a door;

a pair of telescopic mechanisms;

a support for chilled goods, the support being secured to the carcass via the pair of telescopic mechanisms and the pair of telescopic mechanisms being operable to permit the support to move outwardly relative to the carcass and to retract inwardly relative to the carcass; and a pair of cover elements, each cover element having an upper face, longitudinal face and substantially vertical front face substantially covering, respectively, at least an upper face, a longitudinal face facing the support, and a substantially vertical front face of a respective telescopic mechanism;

each cover element including a first part and a second part, separate from the first part, the first and second parts being attachable to one another; wherein the front face of the support is generally co-planar with the front faces of the cover elements.

18. The refrigeration appliance as claimed in claim 17, wherein each cover element is configured at least approximately as a shell having the first and second parts.

19. The refrigeration appliance as claimed in claim 18, wherein the first part of the shell comprises a cut material that forms the upper face and the longitudinal face and the second part of the shell comprises a molded part forming the front face.

20. The refrigeration appliance as claimed in claim 19, wherein the cut material includes a lower face of the shell and the molded part is latched to the upper and lower faces.

21. The refrigeration appliance as claimed in claim 20, wherein the molded part has tabs engaging the upper and lower faces and each tab includes a latching projection engaging in an opening on one of the upper and lower faces.

22. The refrigeration appliance as claimed in claim 19, wherein the cut material is configured as a tube.

23. The refrigeration appliance as claimed in claim 22, wherein a pin on the molded part engages in the tube.

24. The refrigeration appliance as claimed in claim 17, wherein the cover element is configured as a molded part.

25. The refrigeration appliance as claimed in claim 17, wherein the front face of the support is positioned between the front faces of the cover elements, with one said front face of one of the cover elements being positioned on one lateral side of the front face of the support and another said front face of another of the cover elements being positioned on another lateral side of the front face of the support.

26. The refrigeration appliance as claimed in claim 17, wherein each cover element includes a lower base that covers a lower face of a respective telescopic mechanism.

27. The refrigeration appliance as claimed in claim 17, further comprising another support including associated cover elements, wherein the associated cover elements of said another support are closely spaced from the cover elements of the support to form a substantially closed and continuous surface.

28. The refrigeration appliance as claimed in claim 17, wherein the first part comprises metal and the second part comprises a molded material.

* * * * *